US006065262A

United States Patent [19]

Motta

[11] Patent Number: 6,065,262

[45] Date of Patent: May 23, 2000

[54] SYSTEM FOR CONNECTING JUXTAPPOSED SECTIONAL BOARDS

[75] Inventor: Giuseppe Motta, Bellagio, Italy

[73] Assignee: Unifor, S.P.A., Turate, Italy

[21] Appl. No.: 09/110,571

[22] Filed: Jul. 6, 1998

[30] Foreign Application Priority Data

Jul. 11, 1997 [IT] Italy ..... MI970520 U

[51] Int. Cl.[7] ..... E04B 2/74; E04F 19/06

[52] U.S. Cl. ..... 52/582.1; 52/586.1; 52/585.1; 52/592.4; 52/592.5; 52/592.6; 52/800.11; 52/36.4; 52/36.5; 403/354

[58] Field of Search ..... 52/586.1, 585.1, 52/582.1, 592.1, 592.4, 592.5, 592.6, 586.2, 36.4, 36.5, 36.6, 800.1, 800.11; 403/354, DIG. 10; 211/94.01

[56] References Cited

U.S. PATENT DOCUMENTS

| | | | |
|---|---|---|---|
| 2,399,169 | 4/1946 | Crawford | 52/592.1 X |
| 4,047,347 | 9/1977 | Scheid | 52/592.1 X |
| 5,241,796 | 9/1993 | Hellwig et al. | 52/36.4 |
| 5,309,686 | 5/1994 | Underwood et al. | 52/36.5 X |
| 5,412,912 | 5/1995 | Alves | 52/36.5 |

FOREIGN PATENT DOCUMENTS

| | | | |
|---|---|---|---|
| 210269 | 1/1924 | United Kingdom | 403/354 |

*Primary Examiner*—Laura A. Callo
*Attorney, Agent, or Firm*—Wolf, Greenfield & Sacks, P.C.; James H. Morris

[57] ABSTRACT

System for connecting section boards, particularly panel-like elements having rectangular greater surfaces and horizontal greater sides to form partition walls includes two metal sections intended to connect a lower sectional board to an upper sectional board, one metal section being attached to the upper greater horizontal side of the lower sectional board and the other metal section being attached to the lower greater horizontal side of the upper sectional board, said metal sections being connected to each other by means of a tongue-and-groove joint and forming, once they are connected together, a recessed portion extending along the greater horizontal side of the sectional boards and intended to receive and hold therein a corresponding portion of an element or fixture intended to project or to hang from the partition wall.

5 Claims, 2 Drawing Sheets

SYSTEM FOR CONNECTING JUXTAPPOSED SECTIONAL BOARDS

BACKGROUND OF THE INVENTION

This invention generally relates to the furnishings and fittings industry and, more particularly, an improved system for connecting together sectional boards.

DESCRIPTION OF THE PRIOR ART

Sectional boards are from time known in the furnishings and fittings industry and they are used for assembling partitions provided with fixtures and intended to furnish the interior spaces of houses and offices.

Generally, such boards are panel-like elements having the greater surfaces rectangular in shape. The boards can be made of various materials, preferably wood, and have a decorative covering in a precious fabric or wood on their facing portion. The boards are set one above the other along their greater sides and connected together along these sides by means of extruded metal sections, preferably aluminium sections.

According to a prior art embodiment, the boards are arranged so as to have their greater sides in planes parallel to level ground and the sections used for joining the boards can also act as supporting means for shelves, hanging furnitures and the like.

Referring to this particular embodiment, the sections are generally attached to the upper greater side of the boards by means of fastening pins which are inserted in associated holes drilled into the boards and have a flat bearing surface on which the lower greater side of the adjacent board rests.

Such an embodiment has the advantage of permitting shelves and hanging furniture to be positioned in a staggered arrangement and to be moved at will along the overall extent of the partition.

However, the system for connecting sectional boards used in the above mentioned embodiment has now proved to have some drawbacks both from a technical and an aesthetical viewpoint.

As to the first point, it should be noticed that since materials of different characteristics, i.e. metal and wood, are joined together, the accuracy of the connection is generally inadequate. Moreover, due to the fact that only one of the horizontal greater sides of each board is bordered with the metal section, the boards must be handled with special care during manufacture, transport and installation in order to avoid any damage to the horizontal greater side not bordered.

As to the second point, since the boards are joined together at a facing portion, the parting line between materials having different characteristics is apparent and, therefore, it affects the aesthetical appearance of the partition. Furthermore, also an imperfect coplanarity between adjacent boards after their installation can be noticed and the metal section is readily apparent and sometimes it can cause a disturbing reflection of the light rays, especially when it is not finished with a matte surface.

The present invention aims at obviating such drawbacks by providing an improved system for connecting together sectional boards.

SUMMARY OF THE INVENTION

More particularly, according to the invention the system for connecting sectional boards, particularly panel-like elements having rectangular greater surfaces and horizontal greater sides to form partition walls, is characterized in that it comprises two metal sections intended to connect a lower sectional board to an upper sectional board, one metal section being attached to the upper greater horizontal side of the lower sectional board and the other metal section being attached to the lower greater horizontal side of the upper sectional board, said metal sections being connected to each other by means of a tongue-and-groove joint and forming, once they are connected together, a recessed portion extending along the greater horizontal side of the sectional boards and intended to receive and hold therein a corresponding portion of an element or fixture intended to project or to hang from the partition wall.

DESCRIPTION OF THE PREFERRED EMBODIMENTS

Figure 1:
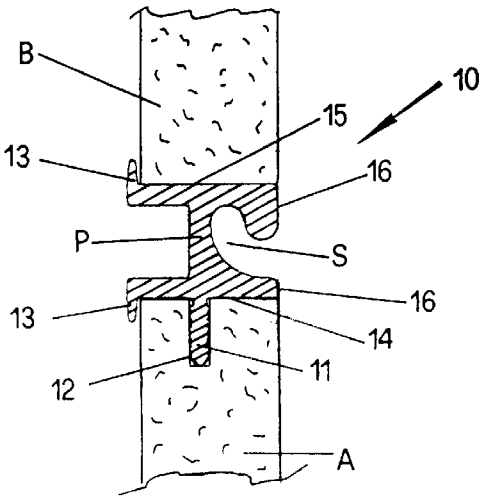
FIG. 1 (PRIOR ART)
FIG. 1 is a cross-sectional view showing a detail of the system for connecting sectional boards according to a prior art embodiment.

Referring to FIG. 1, there is shown a known system 10 for connecting an upper sectional board B and a lower sectional board A, preferably wooden sectional boards inteded to form a partition wall. This system comprises a metal section P attached to the lower sectional board A by means of fastening pins 11 each of which is inserted in a suitable hole 12 drilled into the lower sectional board A. The upper sectional board B is instead simply supported by the metal section P. The rear portion of the metal section P is C-shaped and has two raised edges 13 intended to permit the sectional boards A and B to be accurately positioned one above the other. The metal section P is provided with a recessed portion S in its facing portion intended to receive and hold therein a corresponding portion of an element intended to project or hang from the partition wall, e.g. a shelf or a hanging furniture. The contact surfaces 14 and 15 between the metal section P and the lower and upper seciontal boards A, B, respectively, are flat and parallel to level ground.

According to the connecting system shown in FIG. 1, the connection between adjacent sectional boards occurs at the contact surface 15 and, therefore, between materials having different characteristics, typically the metal section P and the wooden upper sectional board B. Furthermore, the facing portion 16 of the metal section P is relatively large and therefore can be readily seen.

Figure 2:
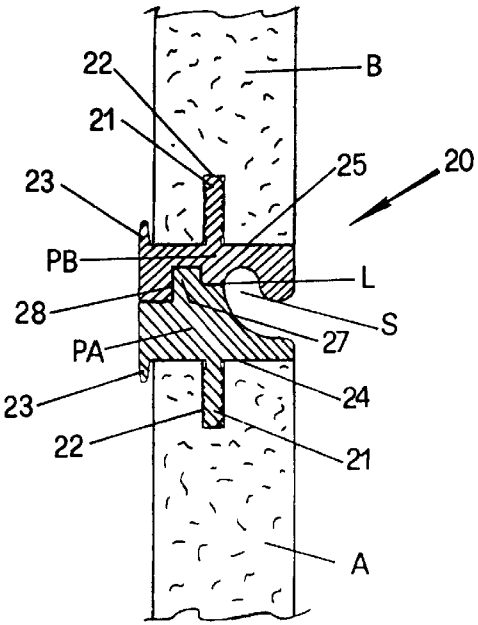
FIG. 2 is a cross-sectional view showing a detail of a first system for connecting sectional boards according to the present invention.

Referring now to FIG. 2, there is shown a first embodiment of the system for connecting sectional boards according to the present invention. The system, generally indicated by 20, comprises two metal sections PA e PB, the first of which is attached to the lower sectional board A, whereas the second is attached to the upper sectional board B. The metal sections PA,PB are attached to the associated sectional boards A,B by means of fastening pins 21 or the like, inserted in suitable holes 22 drilled into the sectional boards.

Likewise according to this embodiment, raised edges 23 are provided for assuring an accurate positioning of the sectional boards A and B. The contact surfaces 24 and 25 between the metal sections PA,PB and the associated sectional boards A,B are flat and horizontal.

According to a feature of the present invention, the connection between the sectional boards A and B is obtained by inserting a projecting rib 27 of the metal section PA in a groove 28 of the metal section PB. Since the connection between the metal sections PA,PB is obtained by means of a tongue-and-groove joint, the accuracy of this connection is higher than that obtained with other known systems. The two metal sections PA, PB, once they are connected, define a recessed portion S extending along the greater horizontal sides of the sectional boards. This recessed portion S is intended to receive and hold therein a corresponding portion of an element intended to project or hang from the partition wall, e.g a shelf or a hanging furniture. Further, the horizontal parting line L between the metal sections PA,PB is out of sight because it is located near the end of a recessed portion S.

Figure 3:
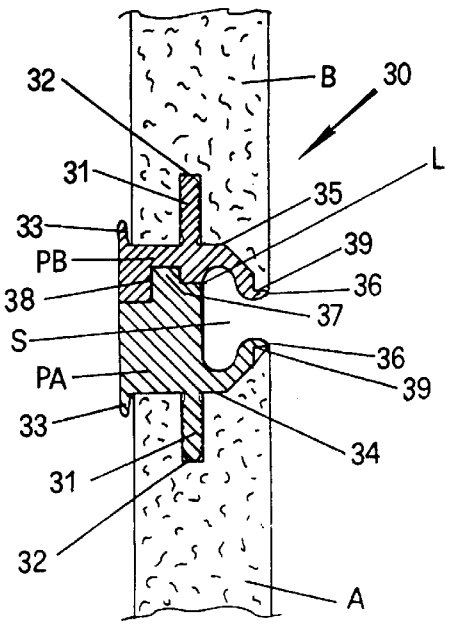
FIG. 3 is a cross-sectional view showing a detail of a second system for connecting sectional boards according to the present invention.

Referring to FIG. 3, there is shown a second embodiment of the system for connecting sectional boards according to the invention. Also this system 30 comprises two metal sections PA and PB intended to connect together a lower and an upper sectional boards A and B. The metal sections PA and PB are attached to the associated sectional boards by means or fastening pins 31 inserted into suitable holes 32 drilled into the sectional boards A and B. Here again raised edges 33 are provided at the rear portion of the metal sections PA and PB for assuring an accurate positioning of the sectional boards A and B. The connection between the metal sections PA and PB is obtained by inserting and projecting rib 37 of the metal section PA into a groove 38 of the metal section PB. Here again, the two metal sections PA, PB, once they are connected, define a recessed portion S extending along the greater horizontal sides of the sectional boards and intended to receive and hold therein a corresponding portion of an element intended to project or hang from the partition wall.

The embodiment shown in FIG. 3 differs from the embodiment shown in FIG. 1 in that the contact surfaces 34 and 35 between the metal sections PA,PB and the associated sectional boards A,B and also the recessed portion S have a different configuration. According to this embodiment of the system of the present invention, the contact surfaces 34 and 35 have a rear flat horizontal portion whereas the front portion thereof converge and terminate with a lip 39 at the facing portion 36. By means of this particular configuration of the contact surfaces 34,35, the facing portion 36 of the sections PA,PB is reduced to a minimum because each metal section PA,PB is at least partially covered by the associated sectional board A or B. This avoids any disturbing reflection of the light rays and, at the same time, improves the aesthetical appearance of the partition wall.

Figure 4:
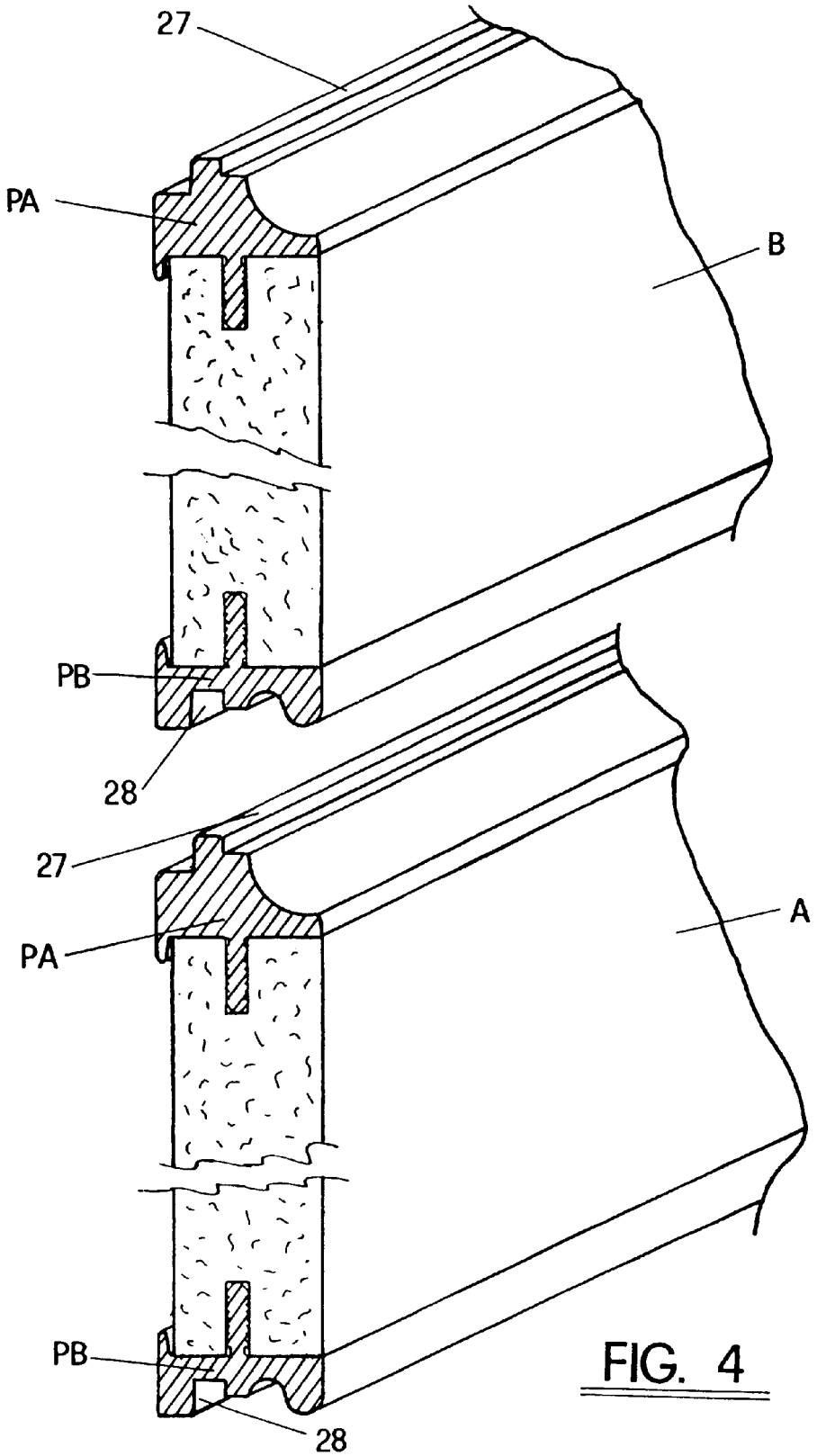
FIG. 4 is a perspective view showing two sectional boards prior to their connection with the system according to the present invention.

Referring to FIG. 4, there are shown two sectional boards A and B ready to be connected together, each of which is bordered with the metal sections PA and PB of the system according to the present invention. Of course, the sectional boards shown are those intended to be arranged in an intermediate position of the partition wall, the bottom and top sectional boards (not shown) of which being bordered in a different manner which is known per se.

The system for connecting sectional boards of the present invention offers the following advantages with respect to known systems:

- the connection between the sectional boards is more accurate because it is obtained by means of a tongue-and-groove joint;
- the parting line between the sectional boards is out of sight and therefore the aesthetical appearance of the partition wall is improved;
- the facing portion of the metal sections used in the connection is reduced to a minimum;
- any possible imperfect coplanarity between the sectional boards cannot be noticed since there is no direct contact between them;
- the sectional boards can be bordered at the workshop;
- the possibility of damaging the sectional boards, at least the intermediate ones, is extremely low.

What is claimed is:

1. A system connecting sectional boards, particularly panel-like elements having rectangular greater surfaces and horizontal greater sides to form partition walls, wherein the system comprises two metal section connecting a lower section board to an upper sectional board, one metal section being attached to the upper greater horizontal side of the lower sectional board and the other metal section being attached to the lower greater horizontal side of the upper sectional board, said metal sections being connected to each other by means of a tongue-and-groove joint and forming, one they are connected together, a recessed portion extending along the greater horizontal side of the sectional boards and intended to receive and hold therein a corresponding portion of an element or fixture intended to project or to hang from the partition wall, wherein the metal sections contact the associated sectional boards through contact surfaces having a flat and horizontal rear portion and a flat and slant front portion terminating with a lip.

2. A system according to claim 1, wherein the metal sections are attached to the associated sectional boards by means of fastening pins intended to be inserted into corresponding holes drilled into the greater horizontal sides of the sectional boards.

3. A system according to claim 1, wherein the metal sections contact the associated sectional boards through flat and horizontal contact surfaces.

4. A system according to claim 1, wherein the flat and slant portions of the contact surfaces between the metal sections and the associated sectional boards are converging in order to reduce to a minimum a facing portion of said metal sections.

5. A system according to claim 1, wherein each metal section is provided with a raised edge at its rear portion for assuring an accurate positioning of the sectional boards.

* * * * *